US009391351B2

(12) United States Patent
Raihn et al.

(10) Patent No.: US 9,391,351 B2
(45) Date of Patent: Jul. 12, 2016

(54) NARROW BAND-PASS FILTER WITH PRIMARY AND SECONDARY SETS OF RESONATORS HAVING OUT-OF-BAND RESONANT FREQUENCIES THAT ARE DIFFERENT FROM EACH OTHER

(71) Applicant: RESONANT INC., Goleta, CA (US)

(72) Inventors: Kurt Raihn, Goleta, CA (US); Neal Fenzi, Santa Barbara, CA (US)

(73) Assignee: RESONANT INC., Goleta, CA (US)

( * ) Notice: Subject to any disclaimer, the term of this patent is extended or adjusted under 35 U.S.C. 154(b) by 0 days.

(21) Appl. No.: 14/484,806

(22) Filed: Sep. 12, 2014

(65) Prior Publication Data

US 2014/0375399 A1 Dec. 25, 2014

Related U.S. Application Data

(63) Continuation of application No. 13/093,539, filed on Apr. 25, 2011, now Pat. No. 8,862,192.

(60) Provisional application No. 61/345,476, filed on May 17, 2010.

(51) Int. Cl.

| | |
|---|---|
| ***H01B 12/02*** | (2006.01) |
| ***H01P 1/203*** | (2006.01) |
| ***H01P 1/205*** | (2006.01) |

(52) U.S. Cl.

CPC ..... *H01P 1/20381* (2013.01); *H01B 12/02* (2013.01); *H01P 1/203* (2013.01); *H01P 1/205* (2013.01)

(58) Field of Classification Search

CPC ..... H01P 1/20381; H01B 12/02
USPC ..... 333/99 S, 204, 219; 505/210
See application file for complete search history.

(56) References Cited

U.S. PATENT DOCUMENTS

| | | | | |
|---|---|---|---|---|
| 4,166,258 | A | 8/1979 | Tseng | |
| 5,254,963 | A | 10/1993 | Bonetti et al. | |
| 5,760,667 | A | 6/1998 | Young et al. | |
| 5,949,306 | A | 9/1999 | Hickernell | |
| 6,026,311 | A | 2/2000 | Willemsen Cortes et al. | |
| 6,633,208 | B2 | 10/2003 | Salkola et al. | |
| 7,072,797 | B2 | 7/2006 | Gorinevsky | |
| 7,138,890 | B2 | 11/2006 | Nakamura et al. | |
| 7,894,867 | B2 | 2/2011 | Matthaei et al. | |
| 8,862,192 | B2 * | 10/2014 | Raihn | 333/204 |

(Continued)

OTHER PUBLICATIONS

Huang, Frederick, Quasi-Dual-Mode Microstrip Spiral Filters Using First and Second Harmonic Resonances, IEEE Transactions on Microwave Theory and Techniques, pp. 742-747, vol. 54, No. 2, Feb. 2006.

*Primary Examiner* — Benny Lee
(74) *Attorney, Agent, or Firm* — Vista IP Law Group LLP

(57) ABSTRACT

A narrowband filter tuned at a center frequency. The filter comprises an input terminal, an output terminal, and a plurality of resonators coupled in cascade between the input terminal and the output terminal. Each of the resonators is tuned at a resonant frequency substantially equal to the center frequency. The resonant frequencies of a primary set of the resonators and a secondary set of the resonators are of different orders.

13 Claims, 10 Drawing Sheets

(56) References Cited

U.S. PATENT DOCUMENTS

| | | | |
|---|---|---|---|
| 2002/0130731 | A1 | 9/2002 | Mansour |
| 2005/0237131 | A1 | 10/2005 | Chang et al. |
| 2007/0247261 | A1 | 10/2007 | Tsuzuki et al. |
| 2008/0278262 | A1 | 11/2008 | Matthaei et al. |
| 2009/0002102 | A1 | 1/2009 | Tsuzuki et al. |
| 2010/0073107 | A1 | 3/2010 | Prophet et al. |

* cited by examiner

NARROW BAND-PASS FILTER WITH PRIMARY AND SECONDARY SETS OF RESONATORS HAVING OUT-OF-BAND RESONANT FREQUENCIES THAT ARE DIFFERENT FROM EACH OTHER

RELATED APPLICATION

The present application is continuation of U.S. patent application Ser. No. 13/093,539, filed Apr. 25, 2011 (now U.S. Pat. No. 8,862,192), which claims the benefit under 35 U.S.C. §119 to U.S. provisional patent application Ser. No. 61/345,476, filed May 17, 2010. The foregoing applications are hereby incorporated by reference into the present application in their entirety.

FIELD OF THE INVENTION

The present inventions generally relate to microwave filters, and more particularly, to microwave filters designed for narrow-band applications.

BACKGROUND OF THE INVENTION

Electrical filters have long been used in the processing of electrical signals. In particular, such electrical filters are used to select desired electrical signal frequencies from an input signal by passing the desired signal frequencies, while blocking or attenuating other undesirable electrical signal frequencies. Filters may be classified in some general categories that include low-pass filters, high-pass filters, band-pass filters, and band-stop filters, indicative of the type of frequencies that are selectively passed by the filter. Further, filters can be classified by type, such as Butterworth, Chebyshev, Inverse Chebyshev, and Elliptic, indicative of the type of bandshape frequency response (frequency cutoff characteristics) the filter provides relative to the ideal frequency response.

The type of filter used often depends upon the intended use. In communications applications, band-pass filters are conventionally used in cellular base stations and other telecommunications equipment to filter out or block RF signals in all but one or more predefined bands. For example, such filters are typically used in a receiver front-end to filter out noise and other unwanted signals that would harm components of the receiver in the base station or telecommunications equipment. Placing a sharply defined band-pass filter directly at the receiver antenna input will often eliminate various adverse effects resulting from strong interfering signals at frequencies near the desired signal frequency. Because of the location of the filter at the receiver antenna input, the insertion loss must be very low so as to not degrade the noise figure. In most filter technologies, achieving a low insertion loss requires a corresponding compromise in filter steepness or selectivity.

In commercial telecommunications applications, it is often desirable to filter out the smallest possible pass-band using narrow-band filters to enable a fixed frequency spectrum to be divided into the largest possible number of frequency bands, thereby increasing the actual number of users capable of being fit in the fixed spectrum. With the dramatic rise in wireless communications, such filtering should provide high degrees of both selectivity (the ability to distinguish between signals separated by small frequency differences) and sensitivity (the ability to receive weak signals) in an increasingly hostile frequency spectrum. Of most particular importance is the frequency range from approximately 800-2,200 MHz. In the United States, the 800-900 MHz range is used for analog cellular communications. Personal communication services (PCS) are used in the 1,800 to 2,200 MHz range.

Microwave filters are generally built using two circuit building blocks: a plurality of resonators, which store energy very efficiently at a resonant frequency (which may be a fundamental resonant frequency $f_0$ or any one of a variety of higher order resonant frequencies $f_1$-$f_n$); and couplings, which couple electromagnetic energy between the resonators to form multiple reflection zeros providing a broader spectral response. For example, a four-resonator filter may include four reflection zeros. The strength of a given coupling is determined by its reactance (i.e., inductance and/or capacitance). The relative strengths of the couplings determine the filter shape, and the topology of the couplings determines whether the filter performs a band-pass or a band-stop function. The resonant frequency $f_0$ is largely determined by the inductance and capacitance of the respective resonator. For conventional filter designs, the frequency at which the filter is active is determined by the resonant frequencies of the resonators that make up the filter. Each resonator must have very low internal resistance to enable the response of the filter to be sharp and highly selective for the reasons discussed above. This requirement for low resistance tends to drive the size and cost of the resonators for a given technology.

For purposes of size reduction, filters often take the form of thin-filmed monolithic structures that are fabricated by depositing metal traces (making up the transmission lines of the resonators) on one side of a dielectric substrate and an insulator on the other side of the dielectric substrate. Historically, filters have been fabricated using normal; that is, non-superconducting conductors. In the case of monolithic filters, the metal traces would be composed of non-superconducting material. These conductors have inherent lossiness, and as a result, the circuits formed from them have varying degrees of loss. For resonant circuits, the loss is particularly critical. The quality factor (Q) of a device is a measure of its power dissipation or lossiness. For example, a resonator with a higher Q has less loss. Resonant circuits fabricated from normal metals in a microstrip or stripline configuration typically have Q's at best on the order of four hundred. With the discovery of high temperature superconductivity in 1986, attempts have been made to fabricate electrical devices from high temperature superconductor (HTS) materials. The microwave properties of HTS's have improved substantially since their discovery. Epitaxial superconductor thin films are now routinely formed and commercially available.

Currently, there are numerous applications where microstrip narrow-band filters that are as small as possible are desired. This is particularly true for wireless applications where HTS technology is being used in order to obtain filters of small size with very high resonator Q's. The filters required are often quite complex with perhaps twelve or more resonators along with some cross couplings. Yet the available size of usable substrates is generally limited. For example, the wafers available for HTS filters usually have a maximum size of only two or three inches. Hence, means for achieving filters as small as possible, while preserving high-quality performance are very desirable. In the case of narrow-band microstrip filters (e.g., bandwidths of the order of 2 percent, but more especially 1 percent or less), this size problem can become quite severe. In a conventional filter design, the resonators are constructed such that they operate at their fundamental resonant frequency (i.e., their lowest fundamental frequency) in order to minimize the size of the filter, as well as to prevent any undesired lower frequency re-entrant resonant frequencies that could potentially pass noise that may interfere with the desired signal.

Though microwave structures using HTS materials are very attractive from the standpoint that they may result in relatively small filter structures having extremely low losses, they have the drawback that, once the current density reaches a certain limit, the HTS material saturates and begins to lose its low-loss properties and will introduce non-linearities in the form of intermodulation distortion. For this reason, HTS filters have been largely confined to quite low-power receive only applications. However, some work has been done with regard to applying HTS to more high-power applications. This requires using special structures in which the energy is spread out, so that a sizable amount of energy can be stored, while the boundary currents in the conductors are also spread out to keep the current densities relatively small.

In one technique of filter design, the resonators are constructed such that they operate a higher order resonant frequency in order to increase the size of the structure. In this manner, the current densities in the resonators are more spread out, thereby minimizing the maximum current peaks and allowing more power to be injected into the filter while maintaining the desired levels of intermodulation distortion. Further details of such higher order filter designs are disclosed in U.S. patent application Ser. No. 12/118,533, entitled Zig-Zag Array Resonators for Relatively High Power HTS Applications," (now U.S. Pat. No. 7,894,867), and U.S. patent application Ser. No. 12/410,976, entitled "Micro-miniature Monolithic Electromagnetic Resonators" (now abandoned), which are expressly incorporated herein by reference.

For example, with reference to FIG. 1, a monolithic, bandpass, radio frequency (RF) filter 10 includes an input terminal (pad) 12, an output terminal (pad) 14, and a plurality of resonators 16 (in this case, fourteen to create fourteen poles) coupled to each other in cascade (i.e., in series) via couplings 18 between the input and output terminals 12, 14. The filter 10 further comprises a substrate 20 on which the terminals 12, 14, resonators 16, and couplings 18 are disposed. In the illustrated embodiment, each of the resonators 16 has a folded transmission line in the form of a spiral-in spiral-out (SISO) pattern, such as those described in U.S. patent application Ser. No. 12/410,976, which has previously been incorporated herein by reference. The nominal length of each transmission line is such that the respective resonator 16 has a second order resonant frequency equal to a desired pass band centered at 835 MHz, as shown in the measured frequency response plot illustrated in FIG. 2. An undesirable first order re-entrant resonant frequency is also shown in FIG. 2.

Significantly, designing the pass band of a filter around higher order resonant frequencies results in undesirable re-entrant resonances lower in frequency than the desired pass band, as well as re-entrant resonant frequencies closer to the pass band at higher frequencies than if the pass band of the filter was designed around the fundamental resonant frequency. The filter 10 has an undesirable lower order re-entrant resonant frequency at of 546 MHz, as shown in the narrowband measured frequency response plot illustrated in FIG. 3, and a desired passband centered at 835 MHz and an undesirable higher order re-entrant resonant frequencies at 1640 MHz, 1920 MHz, 2700 MHz, and 3000 MHz, as shown in the broadband measured frequency response plot illustrated in FIG. 4. The existence of re-entrant resonances in the filter 10 can lead to de-sensitization of a receiver in which the filter 10 is incorporated or unwanted interference if the signal levels at those resonances pass through the filter 10.

There, thus, remains a need to provide a filter that exhibits a considerable increase in power handling over that of typical HTS resonators, while having minimal undesired re-entrant resonant frequencies.

SUMMARY OF THE INVENTION

In accordance with the present inventions, a narrowband filter (e.g., a bandpass filter) tuned at a center frequency (e.g., in the microwave range, such as in the range of 800-900 MHz) is provided. The filter comprises an input terminal, an output terminal, and a plurality of resonators coupled in cascade between the input terminal and the output terminal. Each of the resonators is tuned at a resonant frequency substantially equal to the center frequency. The resonant frequencies of a primary set of the resonators and a secondary set of the resonators are of different orders (e.g., a first order and a higher order). In one embodiment, the primary set of resonators comprises at least two resonators. In this case, the secondary set of resonators (which may number at least two) may be coupled between the primary resonators. Each of the resonators may comprise planar structure, such as a microstrip structure, and may comprise a transmission line composed of high temperature superconductor (HTS) material.

Other and further aspects and features of the invention will be evident from reading the following detailed description of the preferred embodiments, which are intended to illustrate, not limit, the invention.

BRIEF DESCRIPTION OF THE DRAWINGS

The drawings illustrate the design and utility of preferred embodiments of the present invention, in which similar elements are referred to by common reference numerals. In order to better appreciate how the above-recited and other advantages and objects of the present inventions are obtained, a more particular description of the present inventions briefly described above will be rendered by reference to specific embodiments thereof, which are illustrated in the accompanying drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE EMBODIMENTS

Figure 5:
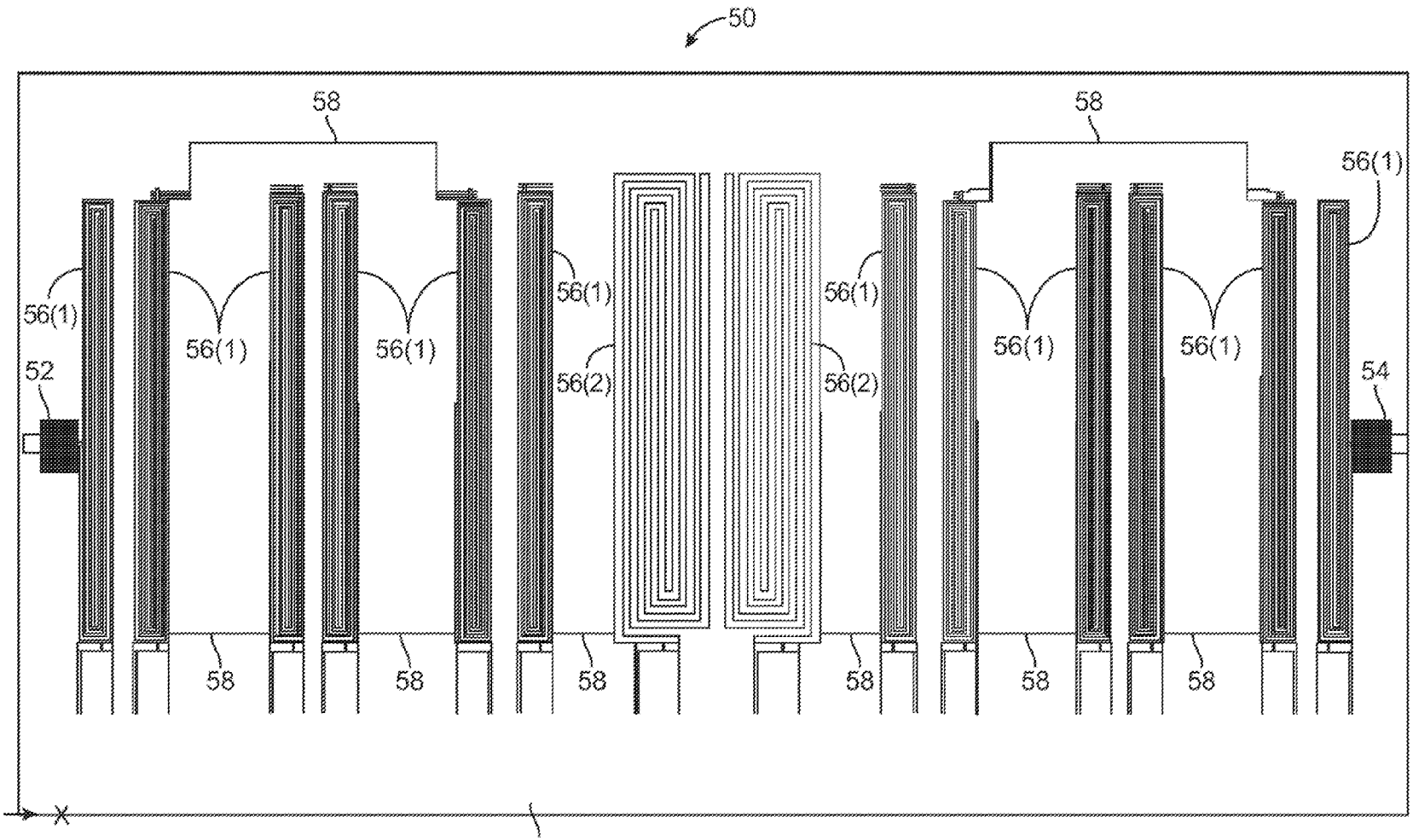
FIG. 5 is a plan view of a monolithic band pass filter constructed in accordance with one embodiment of the present inventions.

Referring to FIG. 5, a narrowband filter 50 constructed in accordance with one embodiment of the present inventions will now be described. In the illustrated embodiment, the RF filter 50 is a band-pass filter having pass band tunable within a desired frequency range, e.g., 800-900 MHz. In a typical scenario, the RF filter 50 is placed within the front-end of a receiver (not shown) behind a wide pass band filter that rejects the energy outside of the desired frequency range.

Figure 1:
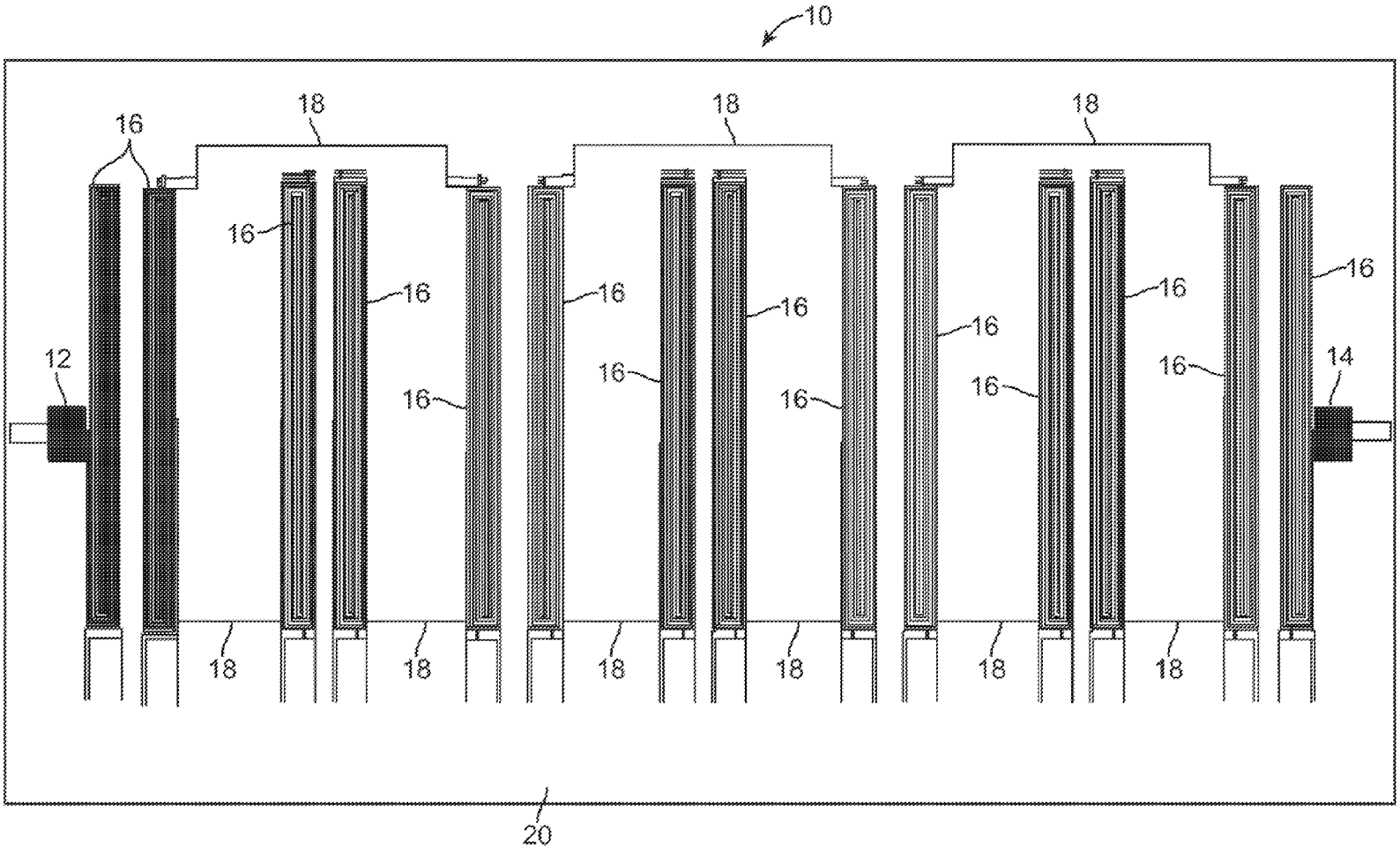
FIG. 1 (PRIOR ART)
FIG. 1 is a plan view of a prior art monolithic band pass filter utilizing second order planar resonators.
Figure 2:
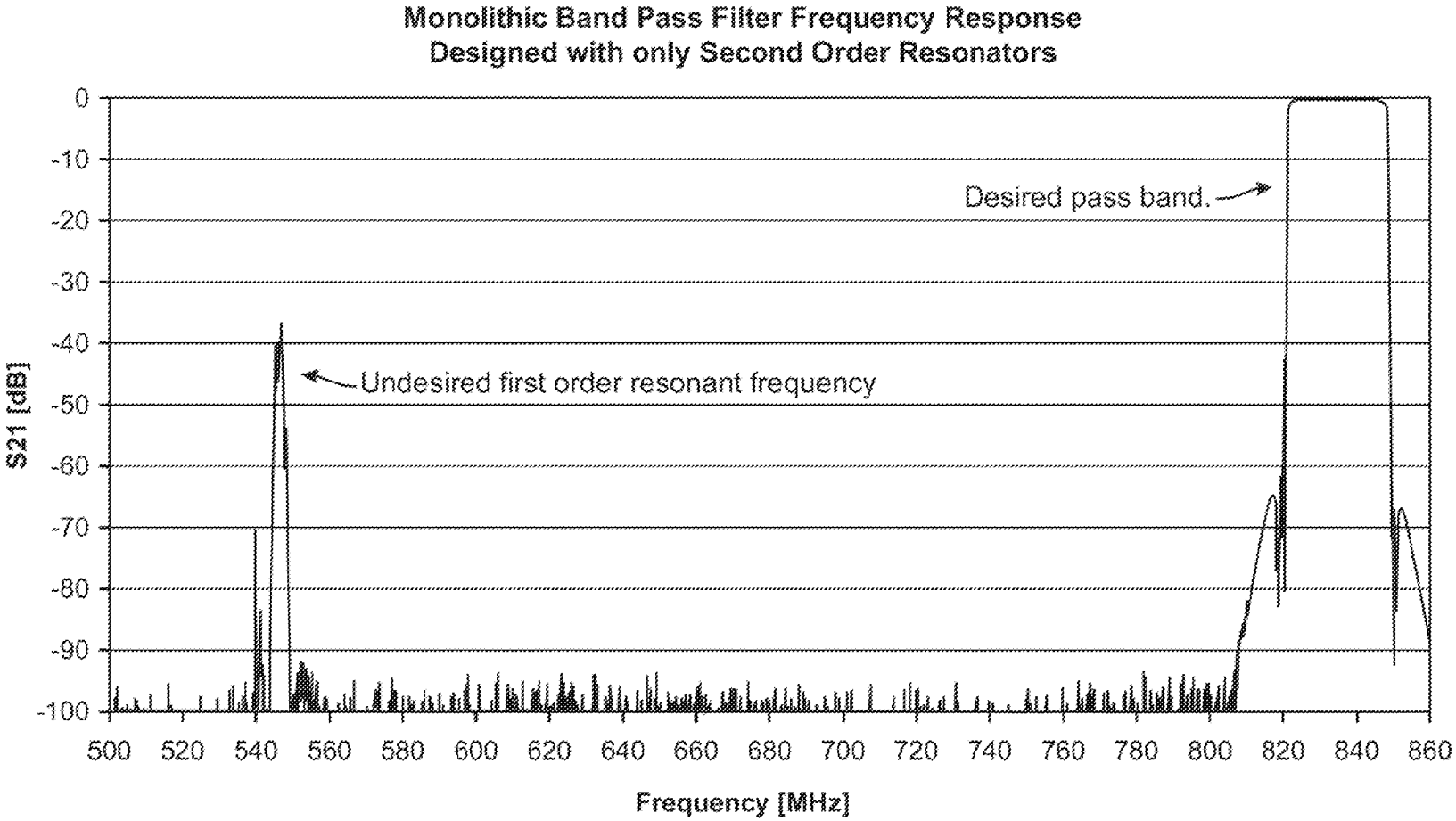
FIG. 2 (PRIOR ART)
FIG. 2 is a measured frequency response plot of the band pass filter of FIG. 1, which plots the S21 power transmission in dB against the frequency in MHz, and particularly shows the pass band of the filter centered around the second order resonant frequency.
Figure 3:
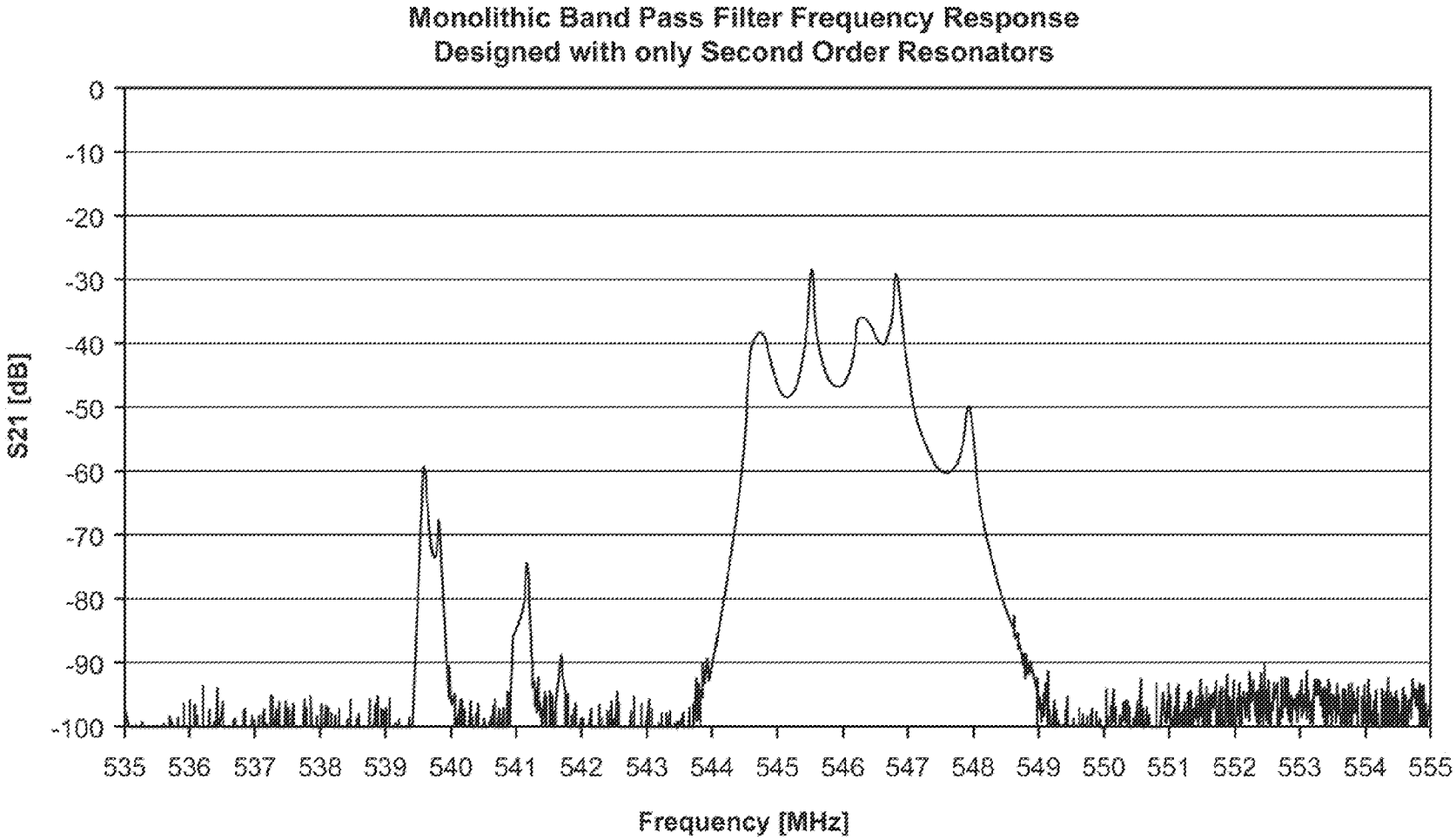
FIG. 3 (PRIOR ART)
FIG. 3 is a narrowband frequency response plot of the band pass filter of FIG. 1, which plots the S21 power transmission in dB against the frequency in MHz, and particularly shows undesirable re-entrant noise at the first order resonant frequency.
Figure 4:
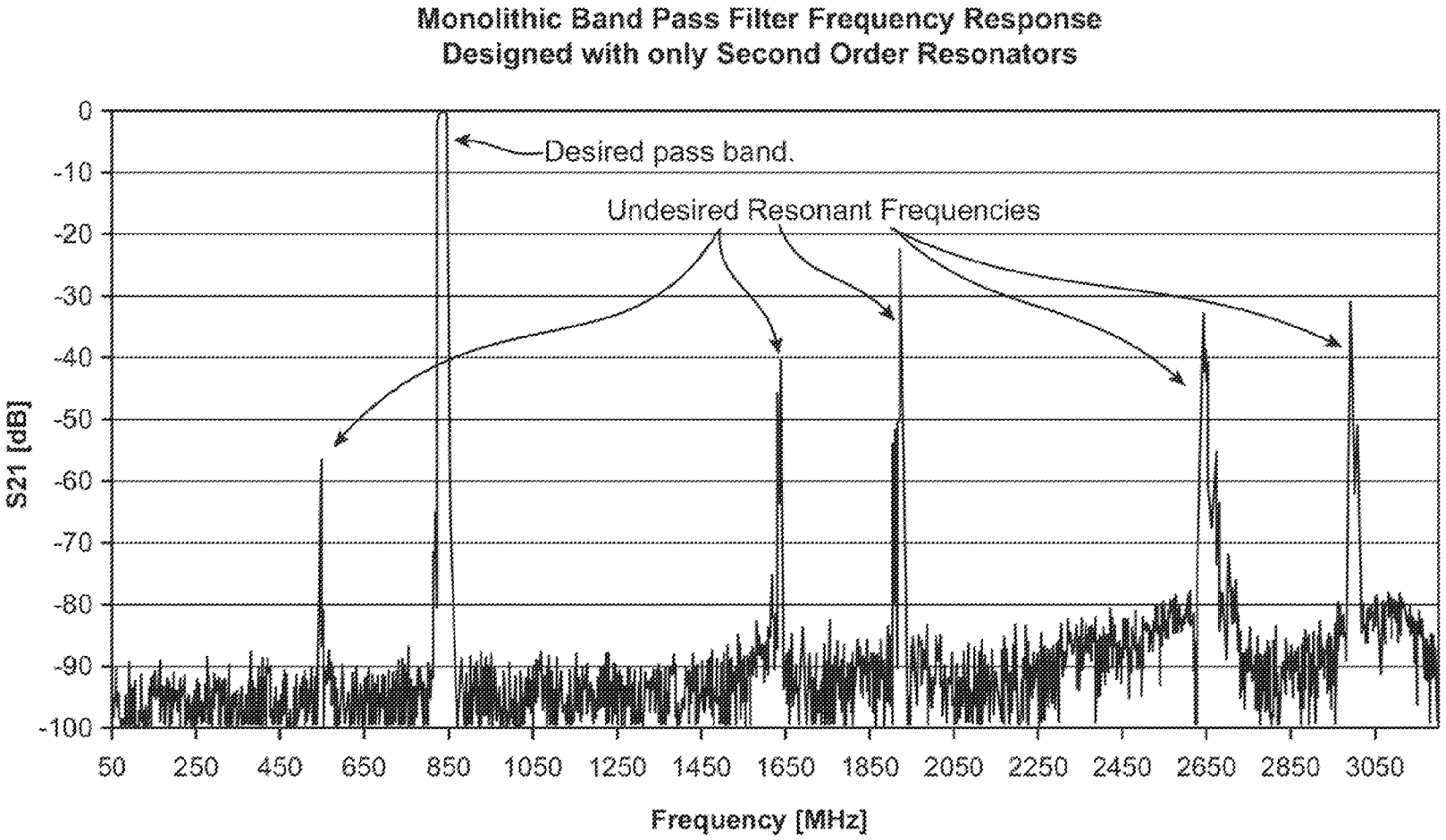
FIG. 4 (PRIOR ART)
FIG. 4 is a broadband frequency response plot of the band pass filter of FIG. 1, which plots the S21 power transmission in dB against the frequency in MHz, and particularly shows undesirable re-entrant noise at the higher order resonant frequencies.
Figure 6:
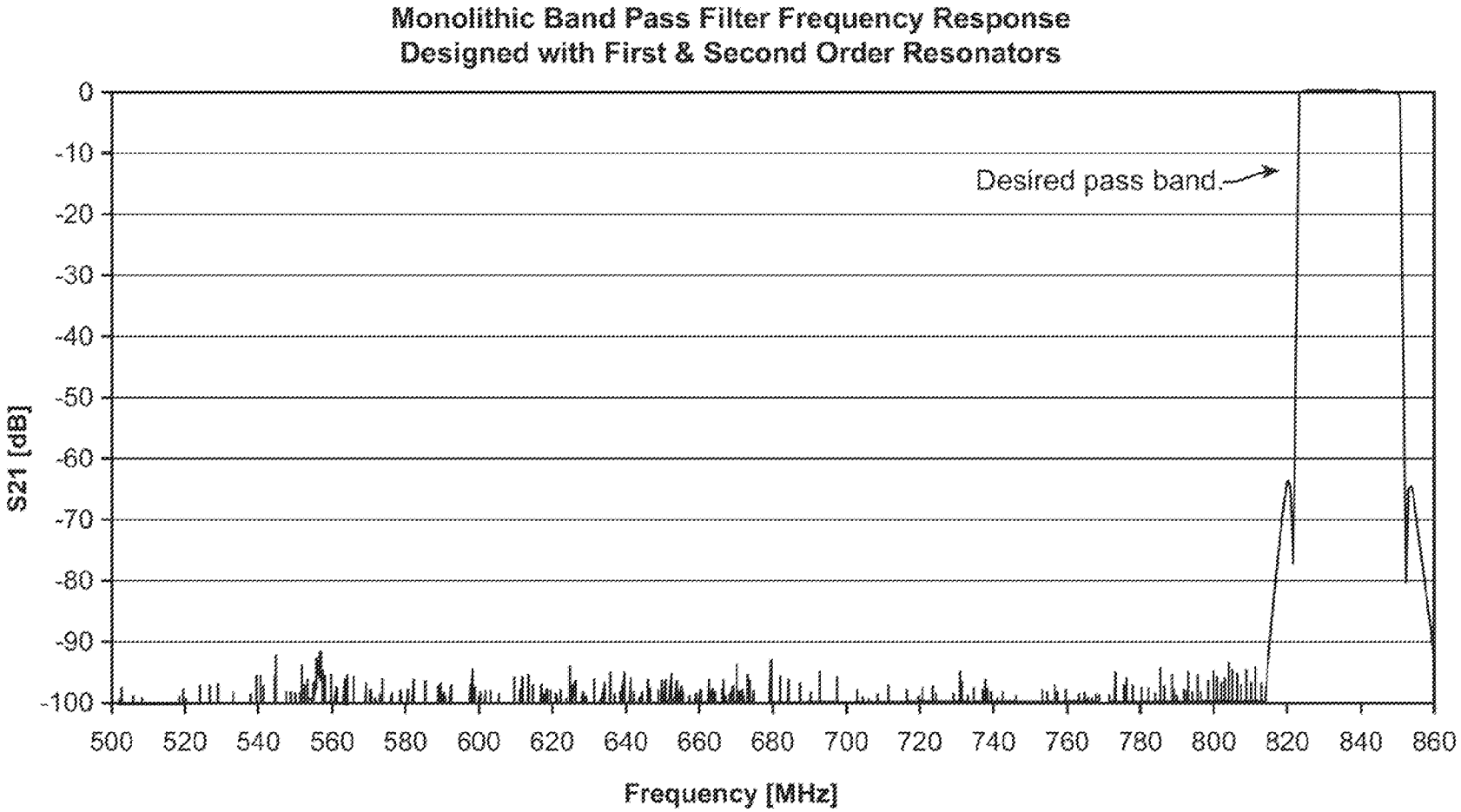
FIG. 6 is a measured frequency response plot of the band pass filter of FIG. 5, which plots S21 power transmission in dB against the frequency in MHz, and particularly shows the pass band of the filter centered around the second order resonant frequency.

The filter 50 is similar to the filter 10 illustrated in FIG. 1 in that it includes an input terminal 52, an output terminal 54, and a plurality of resonators 56 (in this case, fourteen to create fourteen poles) coupled to each other in cascade (i.e., in series) via couplings 58 between the input and output terminals 52, 54, and a substrate 60 on which the terminals 52, 54, resonators 56, and couplings 58 are disposed. Each resonator 56 has a folded transmission line in the form of a spiral-in spiral-out (SISO) pattern, although other types of folded transmission lines can be used, such as zig-zag resonators, spiral snake resonators, etc., described in U.S. Pat. No. 6,026,311, which is expressly incorporated herein by reference. The transmission line of each resonator 56 has a length, such that the resonant frequency of the respective resonator is substantially equal to the designed center frequency of the filter 50, so that the desired pass band of the filter 50 is achieved, as shown in the measured frequency response plot illustrated in FIG. 6. As can be seen from a comparison between the measured frequency response plots illustrated in FIGS. 2 and 6, the desired pass-bands of the filters 10 and 50, which are centered at 835 MHz, are virtually identical.

For ease of manufacturing, the conductive elements (i.e., the terminals 52, 54, resonators 56, and couplings 58) may be monolithically formed onto the substrate 60 using conventional techniques, such as photolithography. In the illustrated embodiment, the conductive elements may be composed of an HTS material, such as an epitaxial thin film Thallium Barium Calcium Cuprate (TBCCO) or Yttrium Barium Cuprate (YBCO). Alternatively, the conductive elements may be composed of superconductors such as Magnesium Diboride ($MgB_2$), Niobium, or other superconductor whose transition temperature is less than 77K as these allow the designer to make use of substrates that are incompatible with HTS materials. Alternatively, the conductive elements may be composed of a normal metal, such as aluminum, silver or copper even though the increased resistive loss in these materials may limit the applicability of the invention. The substrate may be composed of a dielectric material, such as $LaAlO_3$, Magnesium Oxide (MgO), sapphire, Alumina, or commonly used dielectric substrates, like Duroid, FR-4, G10 or other polymer/thermoplastic/glass/ceramic/epoxy composite.

The filter 50 may have a microstrip architecture, and thus, may further comprise a continuous ground plane (not shown) disposed on the other planar side (bottom side) of the substrate 60 opposite to the conductive elements. Alternatively, the filter 50 may have a stripline architecture, in which case, the filter 50 may instead comprise another dielectric substrate (not shown), with the conductive elements being sandwiched between the respective dielectric substrates.

The filter 50 illustrated in FIG. 5 differs from the filter 10 illustrated in FIG. 1 in that the resonators 56 can be divided between a primary set of resonators 56(1) tuned at a resonant frequency of a higher order (e.g., second order) to achieve increased power handling and a secondary set of resonators 56(2) tuned at a resonant frequency of a lower order (e.g., first order). Essentially, the middle two resonators of the conventional filter 50 have been replaced with two resonators having a resonator frequency of a lower order than that of the outer resonators.

Figure 7:
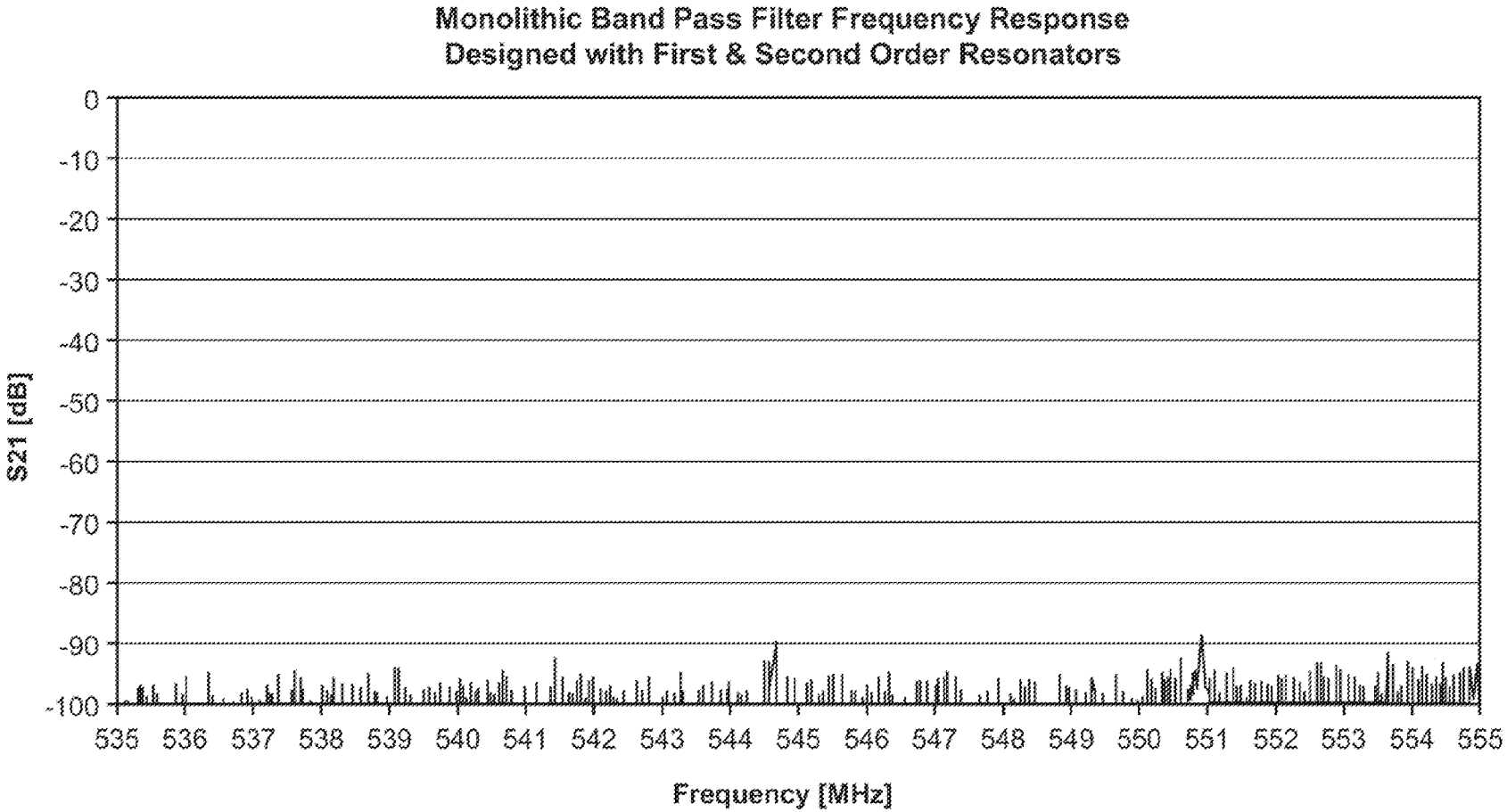
FIG. 7 is a narrowband frequency response plot of the band pass filter of FIG. 5, which plots the S21 power transmission in dB against the frequency in MHz, and particularly shows suppression of the undesirable re-entrant noise at the first order resonant frequency.
Figure 8:
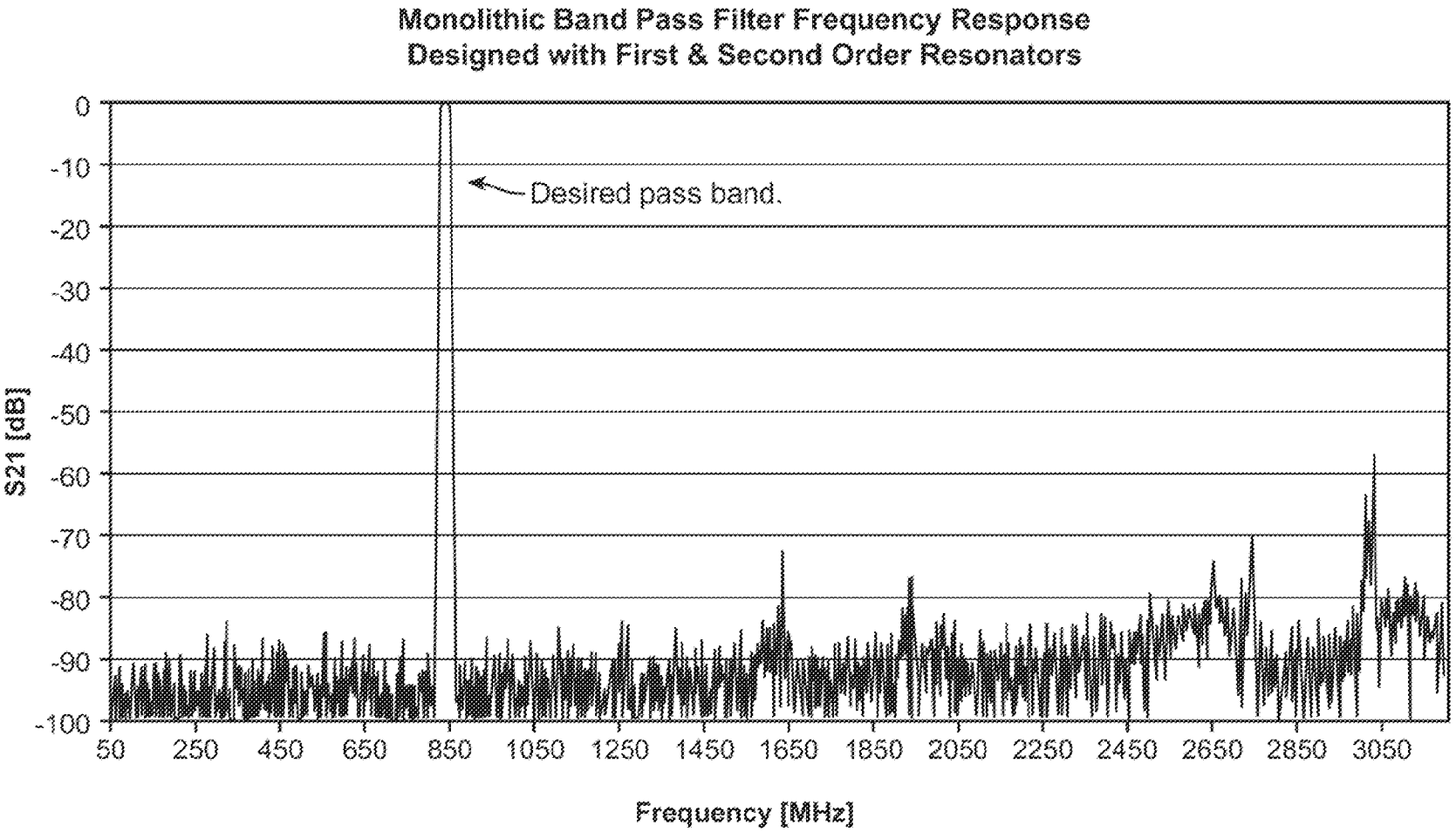
FIG. 8 is a broadband frequency response plot of the band pass filter of FIG. 5, which plots the S21 power transmission in dB against the frequency in MHz, and particularly shows suppression of the undesirable re-entrant noise at the higher order resonant frequencies.

By utilizing one or more resonators that are tuned at a resonant frequency at an order different from the order at which the resonant frequency of each of the primary resonators 56(1) is tuned, the undesirable resonant frequencies of the filter 50 both below and above the designed pass band of the filter 50 are attenuated (the undesired resonant frequency of 546 MHz below the pass band has been attenuated, as can be seen from narrowband frequency response plot illustrated in FIG. 7, and the undesired resonant frequencies of 1640 MHz, 1920 MHz, 2700 MHz, and 3000 MHz above the desired pass band has been attenuated, as can be seen from the broadband frequency response plot illustrated in FIG. 8), while maintaining the overall increased power handling of the filter 50.

Because the resonant frequencies of the respective primary resonators 56(1) and secondary resonators 56(2) do not typically occur at exact multiples of half-wavelengths due to additional fringing capacitances, other than the same resonant frequency at which all of the resonators 56(1) are tuned to achieve the desired pass band, the resonant frequencies of the secondary resonators 56(2) do not coincide with the resonant frequencies of the primary resonators 56(1), very good out-of-band rejection is achieved.

Figure 9:
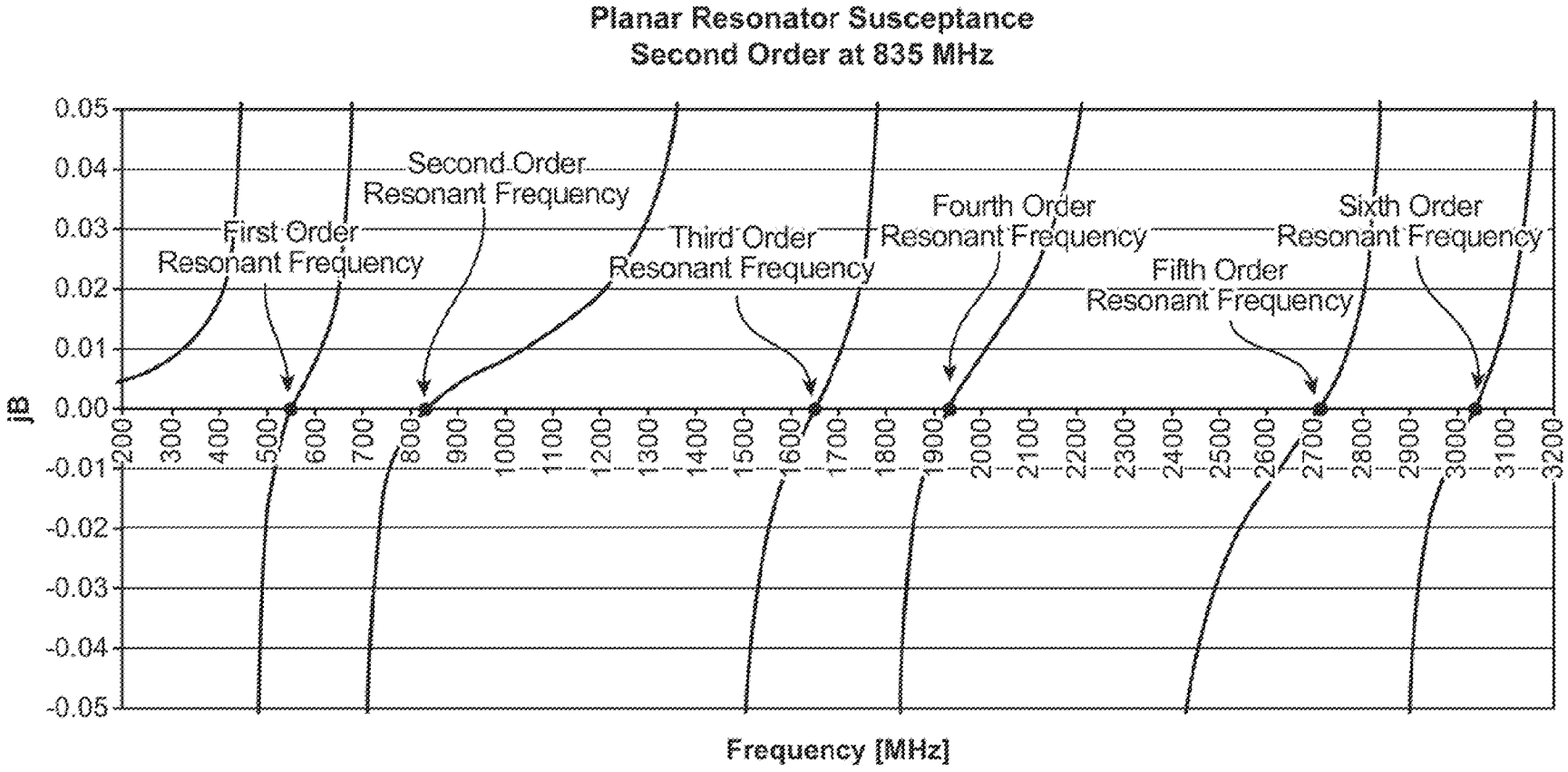
FIG. 9 is a planar resonator susceptance plot showing the resonant frequencies of the primary resonators utilized in the filter of FIG. 5, which plots the susceptance dB against the frequency in MHz.
Figure 10:
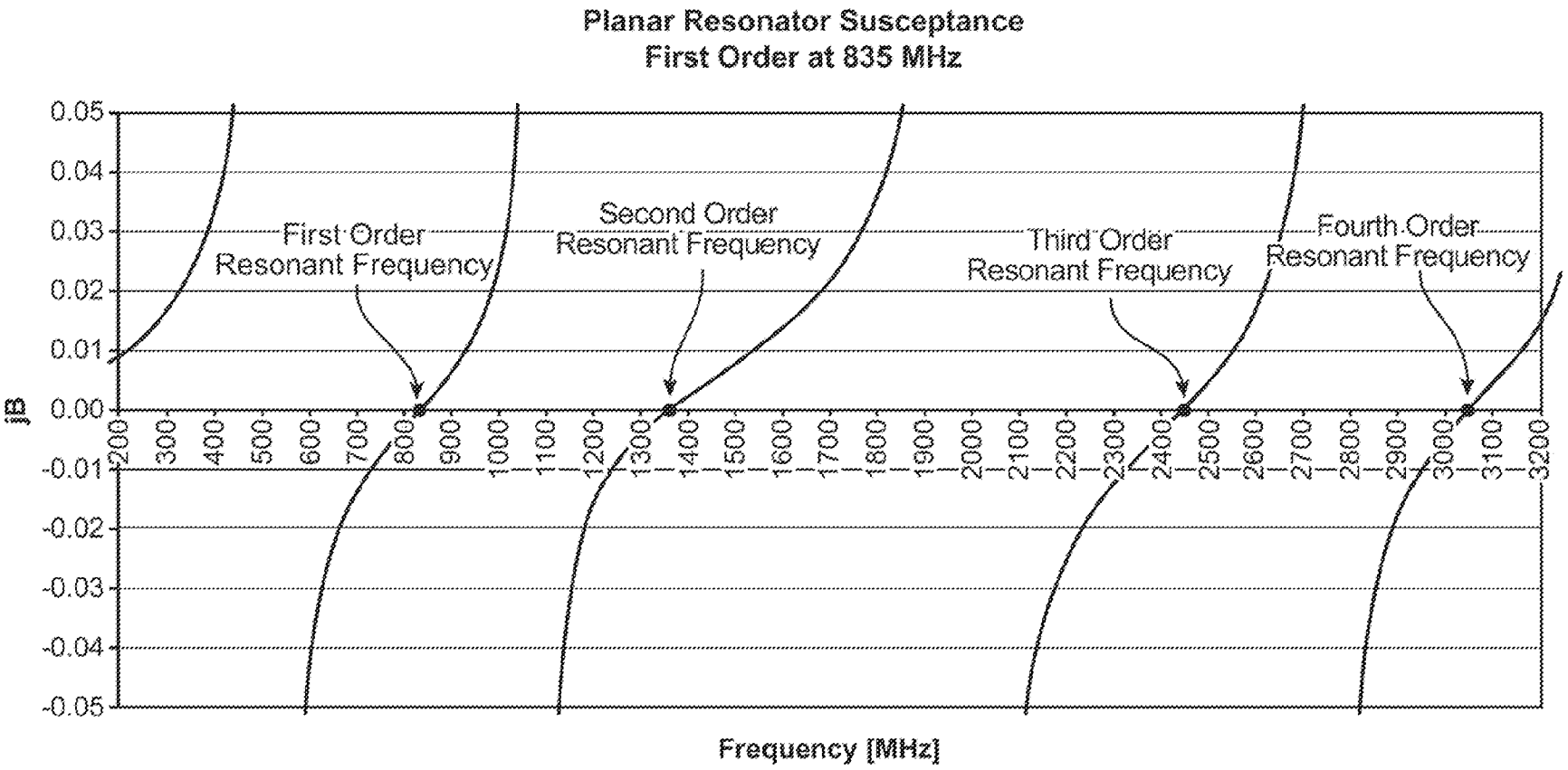
FIG. 10 is a planar resonator susceptance plot showing the resonant frequencies of the secondary resonators utilized in the filter of FIG. 5, which plots the susceptance dB against the frequency in GHz.

In particular, as illustrated in the susceptance plot illustrated in FIG. 9, the first, second, third, fourth, fifth, and sixth order resonant frequencies of each of the primary resonators 56(1) are respectively found at 546 MHz, 835 MHz, 1640 MHz, 1920 MHz, 2700 MHz, and 3000 MHz. As illustrated in the susceptance plot illustrated in FIG. 10, the first, second, third, and fourth order resonant frequencies of each of the secondary resonators 56(2) are respectively found at 835 MHz, 1360 MHz, 2450 MHz, and 3060 MHz. Because the secondary resonators 56(2) are coupled in cascade with the primary resonators 56(1), with the exception of the resonant frequency at 835 MHz about which the pass band is designed for both primary resonators 56(1) and the secondary resonators 56(2), the undesired resonant frequencies of the primary resonators 56(1) are different from the frequencies at which the secondary resonators 56(2) resonant, and therefore, are suppressed.

It should be noted that the operation of the different orders of resonant frequencies are not dependent on the type of coupling from resonator to resonator. Electrical coupling, magnetic coupling, or a combination of both may be used to couple the mixed ordered resonators to one another to create the desired pass band shape about the designed center frequency.

It should also be noted that the resonant frequencies at which the primary resonators 56(1) and secondary resonators 56(2) are not limited to second order and first order, respectively. For example, the primary resonators 56(1) may be tuned at a third order resonant frequency and/or the secondary resonators 56(2) may be turned at a second order resonant frequency. The primary resonators 56(1) and secondary resonators 56(2) can be tuned to resonant frequencies of any different order as long as such resonant frequencies are substantially the same.

Furthermore, although the filter 50 is shown with fourteen resonators 56, any plural number of resonators 56 may be used, as long as it includes resonators tuned to the same resonant frequency of a different order. Also, while the secondary resonators 56(2) are tuned at resonant frequencies of the same order, the secondary resonators 56(2) may be tuned at resonant frequencies of orders different from each other as well as different from the order of the resonant frequency at which the primary resonators 56(1) are tuned, as long as all of the resonators 56 are tuned to the same resonant frequency. For example, a first one of the secondary resonators 56(2) can be tuned to a resonant frequency of a first order and a second one of the secondary resonators 56(2) can be tuned to a resonant frequency of a third order, while the primary resonators 56(1) are tuned to a resonant frequency of a second order. This would result in even greater out of band rejection for the primary resonators 56(1).

It should also be noted although the secondary resonators 56(2) are described as being located in the middle of the filter 50 (i.e., coupled between the primary resonators 56(1)), the secondary resonators 56(2) can be located at the beginning of the filter 50 (i.e., coupled between the input terminal 52 and the primary resonators 56(1)) or at the end of the filter 50 (i.e., coupled between the output terminal 54 and the primary resonators 56(1)). Relative placement of the primary resonators 56(1) and secondary resonators 56(2) will ultimately affect the power handling of the filter 50, so consideration must be made as to the desired functionality of the filter 50. Notably, the first resonator in a filter (i.e. the resonator that sees the incident RF power first) is the most influential on determining the out-of-band intercept point of the filter. The intercept point is a measure of the linearity of a filter so placement of the primary resonators 56(1) at the front of the filter can improve the out-of-band intercept point. Conversely, the middle resonators in a filter are the most influential on determining the in-band intercept point of the filter. By placing the primary resonators 56(1) in the middle of the filter and the secondary resonators 56(2) on the ends of the filter an improvement in the in-band intercept point of the filter can be achieved while enhancing the out of band rejection due to the use of both types of resonators.

Although particular embodiments of the present invention have been shown and described, it should be understood that the above discussion is not intended to limit the present invention to these embodiments. It will be obvious to those skilled in the art that various changes and modifications may be made without departing from the spirit and scope of the present invention. For example, the present invention has applications well beyond filters with a single input and output, and particular embodiments of the present invention may be used to form duplexers, multiplexers, channelizers, reactive switches, etc., where low-loss selective circuits may be used. Thus, the present invention is intended to cover alternatives, modifications, and equivalents that may fall within the spirit and scope of the present invention as defined by the claims.

What is claimed is:

1. A narrowband filter having a desired pass band, comprising:

an input terminal;

an output terminal; and a plurality of resonators coupled in cascade between the input terminal and the output terminal, the plurality of resonators are grouped into a primary set of the plurality of resonators and a secondary set of the plurality of resonators, the primary set of resonators having an in-band resonant frequency and at least one out-of-band resonant frequency, wherein the secondary set of resonators have a plurality of resonant frequencies, all of which are different from the at least one out-of-band resonant frequency of the primary set of resonators, such that the at least one out-of-band resonant frequency of the primary set of resonators is suppressed.

2. The narrowband filter of claim 1, wherein the plurality of resonators are coupled between the input terminal and the output terminal in a manner that characterizes the filter as a band-pass filter.

3. The narrowband filter of claim 1, wherein each of the secondary set of resonators has an in-band resonant frequency that is of a different order than the in-band resonant frequency of the primary set of resonators, wherein the in-band resonant frequency of the primary set of resonators and the each in-band resonant frequency of the secondary set of resonators are substantially equal to a center frequency of the desired pass band of the narrowband filter.

4. The narrowband filter of claim 3, wherein the in-band resonant frequency of the primary set of resonators is a second order, and the in-band resonant frequency of each of the secondary set of resonators is a first order.

5. The narrowband filter of claim 1, wherein the at least one out-of-band resonant frequency of the primary set of resonators comprises a plurality of out-of-band resonant frequencies.

6. The narrowband filter of claim 1, wherein the primary set of resonators comprises at least two resonators.

7. The narrowband filter of claim 6, wherein the secondary set of resonators is coupled between the at least two resonators.

8. The narrowband filter of claim 7, wherein the secondary set of resonators comprises at least two resonators.

9. The narrowband filter of claim 1, wherein each of the plurality of resonators comprises a planar structure.

10. The narrowband filter of claim 1, wherein each of the plurality of resonators comprises a microstrip structure.

11. The narrowband filter of claim 1, wherein each of the plurality of resonators comprises a transmission line composed of high temperature superconductor (HTS) material.

12. The narrowband filter of claim 1, wherein a center frequency of the pass band is in the microwave range.

13. The narrowband filter of claim 12, wherein the center frequency is in the range of 800-900 MHz.

* * * * *